US005778748A

United States Patent [19]

Beijen

[11] Patent Number: 5,778,748

[45] Date of Patent: Jul. 14, 1998

[54] OFFSET CRANK ACTIVATED PAPER DIE CUTTERS

[75] Inventor: James H. Beijen, Mountain Home, Ark.

[73] Assignee: School Systems Inc., Mountain Home, Ark.

[21] Appl. No.: 635,564

[22] Filed: Apr. 22, 1996

[51] Int. Cl.[6] ..... B26D 5/10; B26D 5/16

[52] U.S. Cl. ..... 83/529; 83/541; 83/588; 83/628; 83/633; 83/859

[58] Field of Search ..... 83/531, 533, 541, 83/628, 633, 284, 285, 588, 821, 859, 529, 566; 220/503, 504, 507

[56] References Cited

U.S. PATENT DOCUMENTS

| | | | |
|---|---|---|---|
| D. 257,777 | 1/1981 | Eichenberg et al. | D18/15 |
| D. 296,565 | 7/1988 | Eichenberg et al. | D18/14 |
| D. 341,842 | 11/1993 | Eichenberg et al. | D15/123 |
| D. 359,967 | 7/1995 | Eichenberg et al. | D15/123 |
| 411,758 | 9/1889 | Campbell et al. . | |
| 1,338,457 | 4/1920 | McBee | 83/588 |
| 2,373,121 | 4/1945 | Kipp | 83/633 X |
| 3,228,275 | 1/1966 | Taber | 83/588 |
| 3,735,659 | 5/1973 | Button | 83/588 X |
| 4,065,990 | 1/1978 | Edhlund | 83/133 |
| 4,586,414 | 5/1986 | Block | 83/522 |
| 4,867,022 | 9/1989 | Hird | 83/529 X |
| 5,131,559 | 7/1992 | Ariyoshi et al. | 220/507 X |
| 5,142,973 | 9/1992 | Tur et al. | 83/588 X |
| 5,172,622 | 12/1992 | Sabin | 83/520 |
| 5,255,587 | 10/1993 | Eichenberg et al. | 83/628 |
| 5,647,260 | 7/1997 | Nabity | 83/DIG. 1 X |

FOREIGN PATENT DOCUMENTS

| | | | |
|---|---|---|---|
| 701749 | 12/1953 | United Kingdom | 83/633 |

OTHER PUBLICATIONS

Advertisement brochure for Martin Magic Lettermaker, No Date.

*Primary Examiner*—Eugenia Jones
*Attorney, Agent, or Firm*—Stephen D. Carver

[57] ABSTRACT

Manually and electrically powered die cutting machines for making paper cutouts with replaceable dies. A generally cubicle platen cutting head preferably mounted on a supporting cabinet comprises a rigid, supporting base with a pair of outwardly projecting, parallel side plates that surround a pair of spaced apart platens. A stationary platen is fixed between the sides. A movable platen is laterally suspended between the sides away from the fixed platen, defining a die-receptive compartment therebetween. A die selected to produce the desired shape, and the paper to be cut, are inserted within the die-receptive compartment in sandwiched relation before platen compression. The movable platen is suspended by pins projecting laterally away from its edges that engage suitable follower slots defined in the side plates. A crankshaft assembly pivots an elongated, roller-equipped crankshaft to displace the movable platen for cutting. The rollers physically contact the movable platen and non-destructively roll along its surface as the platen is compressed against the die. The manual embodiments are driven by a handle. The electric embodiment employs a motor-driven screw jack for crankshaft actuation.

11 Claims, 13 Drawing Sheets

76
20

30
91
26
55
66
64
56
94
70
72
68
60
86
74
55
102
92
84
50
21
22
44
40
94
46
42
31
58
54
43
22A
24

OFFSET CRANK ACTIVATED PAPER DIE CUTTERS

BACKGROUND OF THE INVENTION

I. Field of the Invention

This invention relates generally to platen activated cutting devices, including die cutters for paper and the like. More particularly, the present invention relates to hand operated die cutting machines.

II. Description of the Prior Art

In the prior art, numerous dies have been proposed for cutting paper. A variety of prior art die cutting machines comprise one or more rigid, displaceable platens that are forced into engagement to either mark, imprint or cut planar material. The prior art is literally replete with various forms of automatic, high speed die cutting machines designed for mass production. Such machines are capable of producing large quantities of custom configured items. However, slower, relatively less complicated manual die cutting machines have nevertheless gained market acceptance.

In recent years manual die cutting machines for children have become popular in schools. Typical manual die cutters use a plurality of interchangeable die elements that can be quickly inserted by hand to cut construction paper. Such devices operate a selected die sandwiched between cooperating platens that are compressed by a simple handle. When the platens are forced together, the cutting die driven by the movable platen will grove, imprint or cut construction paper (or other planar items) and provide a simple cutout. Numerous conventional dies are available to provide cutouts in a variety of user-selected forms, including, for example, rabbits and other animals, stars, snowflakes, geometrical shapes, and other items of interest to children.

One prior art device known to me was sold in the United States under the trademark MARTIN MAGIC LETTER MAKER™. That device comprises a generally planar base to which a stationary platen is affixed. A pair of vertically oriented end plates are disposed on opposite sides of the platen. A pivot shaft is journaled between the end plates, and it is splined to a pair of cams. The cams drive a reciprocating, generally rectangular platen. An elongated handle rotates the cams to force the displaceable platen either upwardly and downwardly. When a cutting die is forced against construction paper, a desired paper cutout results.

Another prior art paper cutting die press is seen in U.S. Pat. No. 5,255,587 issued Oct. 26, 1993. The disclosed device includes a rigid, metallic base that supports a fixed platen and a spaced-apart reciprocating platen. A sleeve captivates a rotatable shaft that drives suitable cams therewithin forcing the reciprocating platen upwardly and downwardly. The cam members are mounted to a pair of stub axles that are received within opposites sides of the device. The cam member is housed within a bearing and drives a channel block means that directly contacts the upper or movable platen. As the handle is manually rotated, the platens are forced together and any paper disposed within the cutting die between the platens is cut as desired by the operator. The channel block and bearing arrangement is necessary to both control vertical displacements of the upper platen, and to prevent the marring of its surface. While this presents an advantageous mechanical arrangement, it significantly increases the costs of the apparatus. The latter device is also seen in U.S. Design Pat. No. 341,842 issued Nov. 30, 1993. Related design patents for similar structures are seen in U.S. Design Pat. Nos. 359,967; 257,777; and 296,565.

U.S. Pat. No. 4,065,990 clearly shows a similar device wherein a rigid, generally rectangular platen is moved upwardly and downwardly. A pair of sides project upwardly from a lower base plate on opposite edges of the platen. An elongated shaft is journalled for rotation between the side plates, and it moves a pair of cams that directly contact the exposed outer surface of the movable platen. As the handle is rotated, the upper platen is moved downwardly similarly to the operation of the die cutting presses discussed above. A disadvantage with this design is that the upper platen is directed contacted by the revolving cams, and repeated frictional metal-to-metal contact can mar the finish and disfigure the appearance of the device. Further, special care must be taken to insure the alignment of the moving platen as the apparatus is used. However, devices embodying the platen-drive concepts of the latter design are cost competitive.

U.S. Pat. No. 5,172,622 shows an analogous device in which a platen is moved upwardly or downwardly for die cutting. However, instead of propelling the platen through a captivated cam system, lever-driven, axially displaceable linkage directly controls the platen. U.S. Design Pat. No. 411,758 shows a similar handle that is arranged as a wedge for driving a platen vertically upwardly and downwardly in a die cutter of the character described.

An electrical system for activating an arguably similar platen system is seen in U.S. Pat. No. 4,586,414.

I have designed a system that is primarily adapted for die cutting for children. The system readily interfits with a variety of interchangeable dies, that can be configured to produce a variety of popular shapes. Such a device must be stable and easy for children to operate with a simple handle. A workable design must avoid marring of the platen. At the same time, cost prohibitive aspects such as the above discussed captivated bearing system should be avoided if a cost effective device is to be marketed. Concurrently with design simplification and cost reduction, platen surface disfiguration and wear must be minimized in a competitive machine.

SUMMARY OF THE INVENTION

My improved paper cutting die machines are available both in manual and electrically powered embodiments. Both function reliably and safely to produce paper cutouts from conventional dies that are suitable for children. The manual and electric designs include a unique, crankshaft-operated platen system that prevents surface marring of the platen.

The manual die cutting machine is operated by an elongated handle. The handle functions as a lever, and extends to a platen cutting head conveniently mounted on a supporting cabinet. The optional cabinet is preferably divided into multiple receptacles for storing a quantity of different dies.

Each die cutting head comprises a rigid, supporting base from which a pair of gently rounded, side plates upwardly project. Preferably the base is recessed within the cabinet. In alternative embodiments the configuration of the base and the side plates is varied.

A lower, stationary platen is disposed upon the base between the sides. An upper, movable platen is secured between the sides above the fixed platen. A die-receptive compartment is thus defined between the spaced apart platens. A desired die and the selected planar material to be cut (i.e., construction paper) are inserted within the latter compartment prior to platen compression.

The movable platen is suspended by pins projecting laterally away from its edges that engage suitable follower slots defined in the side plates. A crankshaft assembly above the movable platen is lever-activated by the handle to displace the movable platen for cutting. The crankshaft assembly comprises a rigid pivot axle journalled between the side plates above the movable platen. Rigid pivot blocks are splined to opposite ends of the pivot shaft. The handle is connected to the pivot blocks to force the crankshaft assembly to rotate, thus causing cutting. A rigid crankshaft extends between the pivot blocks offset from the pivot axle. Rollers are fixed to each end of the crankshaft.

As the handle is moved the pivot blocks rotate about the axle, and the crankshaft and its rollers move in an arc, non-destructively contacting and compressing the movable platen. The rollers smoothly glide over the exposed platen surface without marring the finish. At the same time the movable platen is driven downwardly towards the stationary platen, compressing the die within the now-shrinking die compartment against the lower platen. At this time the die blade cuts the paper. Preferably it bears against a resilient pad disposed on the fixed platen.

The electrically powered cutting die described herein, comprises a rigid, lower housing supporting an upper platen, cutting head. A motor-driven screw jack operates the movable platen through a similar crankshaft assembly. A pivot axle journalled between sides of the lower housing is linked to pivot blocks forming a lever. An electric drive motor threadably drives a screw jack that rotates the pivot blocks to retract or extend the crankshaft. As in the case of the manual unit, the crankshaft extends between the pivot blocks and is offset from the pivot axle. It comprises a pair of rollers that smoothly contact the movable platen within the cutting head during operation.

Thus, an important object is to provide both manual and electric die cutting machines for inexpensively making paper cutouts.

Another important object is to avoid marring the surface of the displaceable platens.

Another fundamental object is to provide paper die cutting machines of the character described which can quickly receive a variety of interchangeable dies used for cutting paper.

Yet another object is to provide a die cutting machine than can be safely used by children.

Another object is to provide die cutting machines of the character described that maintain platen alignment.

A related object is to provide a means for adjusting platen deflection in a die cutting machine of the character described without using prior art shims.

Still another object is to provide a die cutter of the character described which can be easily used for a wide variety of applications and can produce an almost an infinite number of shapes and figures.

Another object is to provide a die cutting machine of the character described that avoids the use of expensive captivated bearings, but nevertheless preserves the finish and aesthetic appearance of the platen.

Still further object is to provide a die cutting machine of the character described that can be used with a wide variety of materials including construction paper, lightweight cardboard, mild or plastic and the like.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
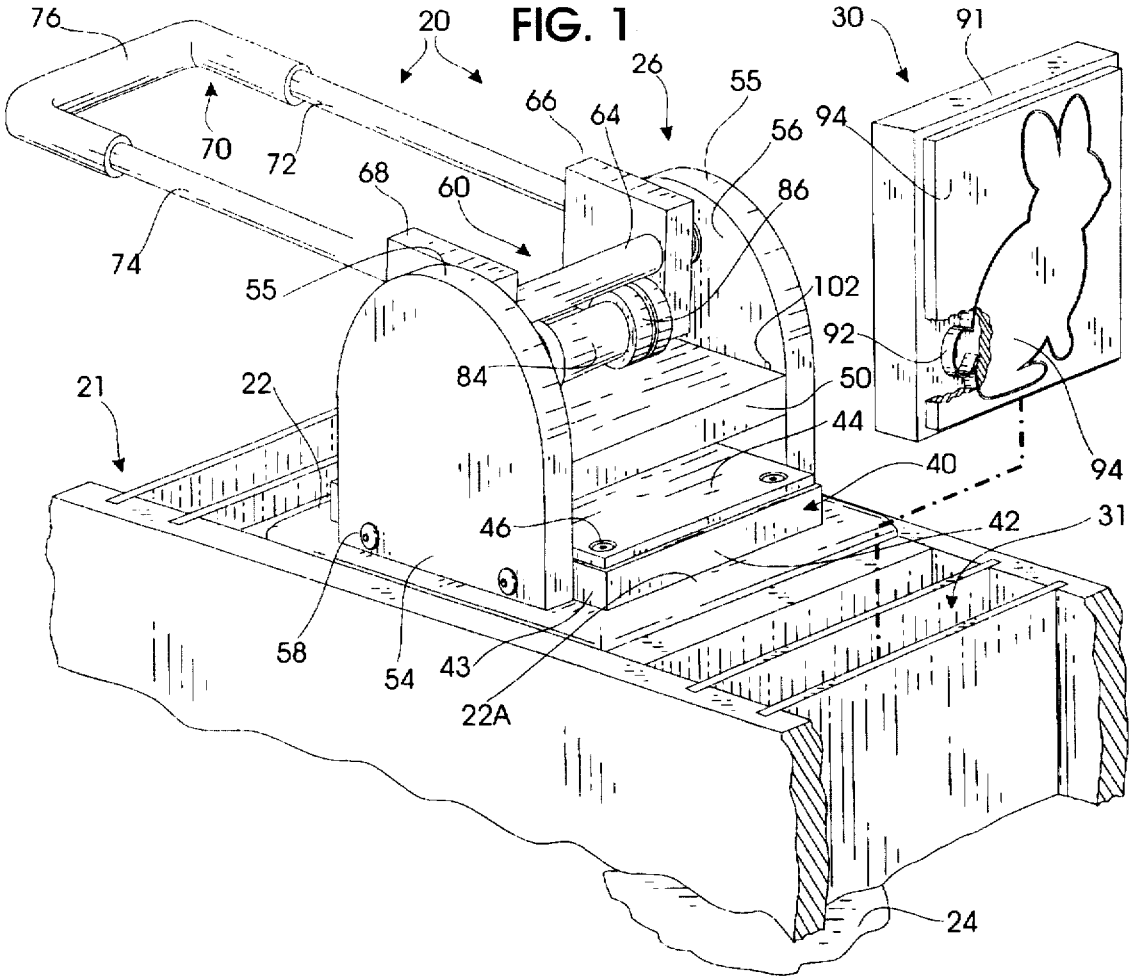
FIG. 1 is a fragmentary and partially exploded front isometric view of a manually operated embodiment of my preferred Offset Crank Activated Die for Cutting Paper, with portions thereof shown in section for clarity.

With initial reference directed to FIGS. 1–9 of the appended drawings, the best mode of my manual die cutting machine has been generally designated with the reference numeral 20. FIGS. 1A and 1B reveal alternative designs that omit the cabinet and have alternative base plates. As explained in detail hereinafter, the best mode of my electric die cutting machine is illustrated in FIGS. 10–14.

The preferred manually operated die cutting machine 20 comprises a die cutting head 26 preferably centered on top of a generally rectangular cabinet 21 disposed upon a suitable supporting surface 24. The optional cabinet 21 has an open top separated into multiple, adjacent receptacles 31 in which replaceable dies 30 to be hereinafter described may be stored. The die cutting head 26 preferably comprises a rigid, rectangular supporting base 22. In the best mode base 22 is received within a suitable recess defined on top of cabinet 21. Alternatively, base 22 may be replaced with larger alternative bases 27A or 27B (FIGS. 1A, 1B), or it may rest directly upon supporting surface 24. The preferred base 22 is generally square when fitted to the cabinet. However, in FIG. 1A the base plate 27A is elongated and rectangular, whereas in FIG. 1B the base plate 27B is in the shape of an oval. Nevertheless, in all embodiments, it is best that the die cutting head assembly 26 is supported by a firm base.

Head 26 preferably comprises a lower, stationary platen assembly 40 of somewhat square dimensions. In the best mode platen 40 assembly comprises a lower, rectangular platen 42 and an overlying, generally rectangular, resilient pad 44 against which the cutting die 30 will be pressed. Platen 42 is fixed in position during operation. Suitable fasteners 46 secure the stationary platen assembly 40 to the base 22. Additionally, resilient pad 44 can be adhesively affixed to plate 42. Alternatively, the platen assembly 40 may omit plate 42, and in the latter case pad 44 would be affixed directly to surface 22A (FIG. 1) of base 22 that would function as a stationary platen.

Figure 1A:
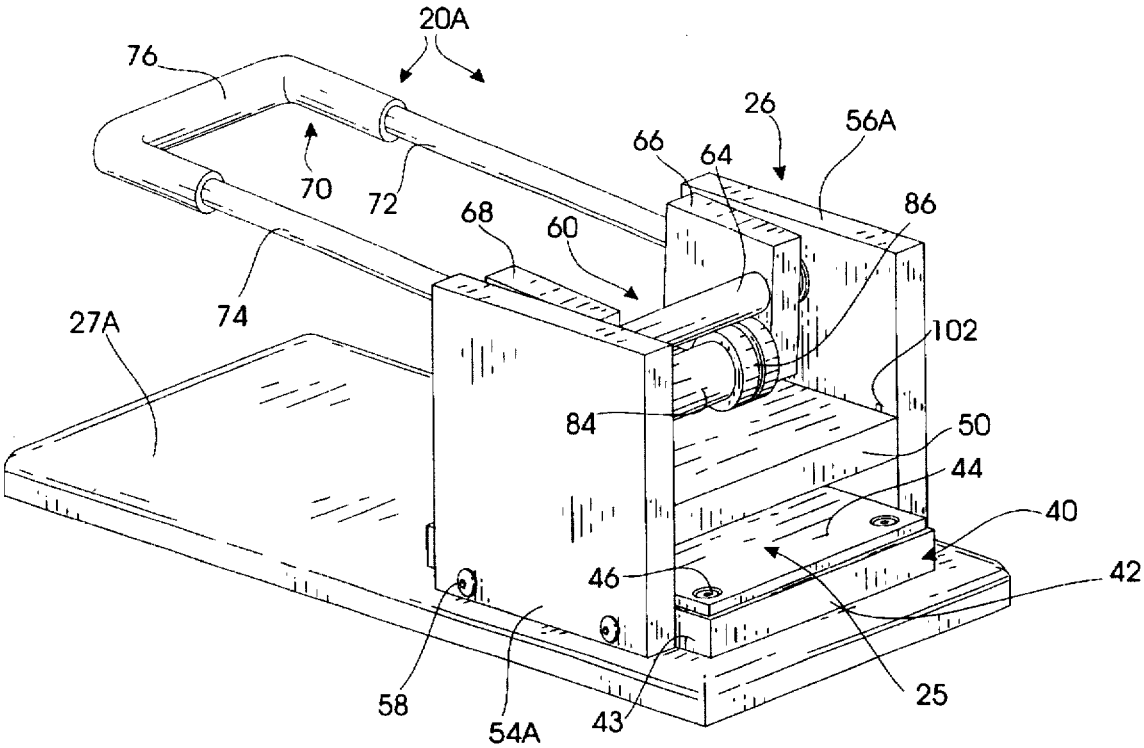
FIG. 1A is an isometric view of an alternative manually operated die cutter with the cabinet omitted, and showing an alternative base plate.
Figure 1B:
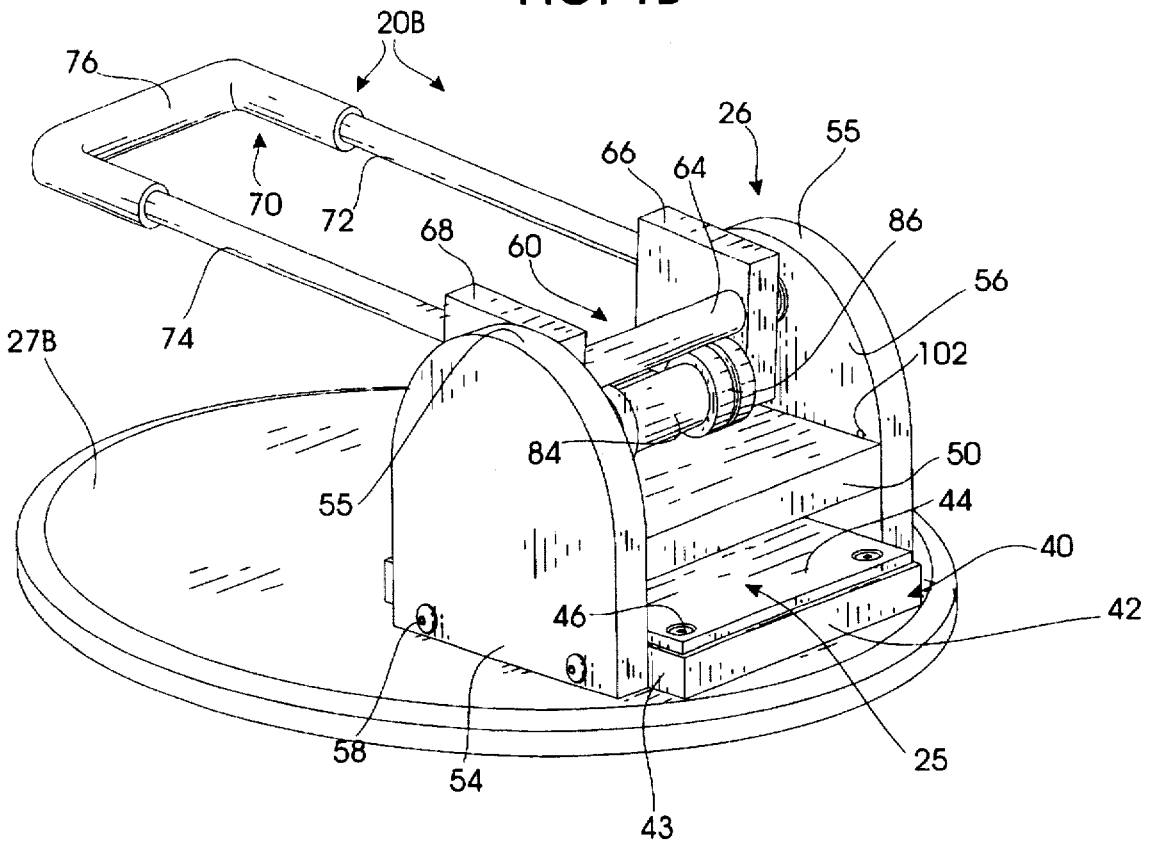
FIG. 1B is an isometric view of another alternative manually operated die cutter with the cabinet omitted, showing an alternative base plate.
Figure 2:
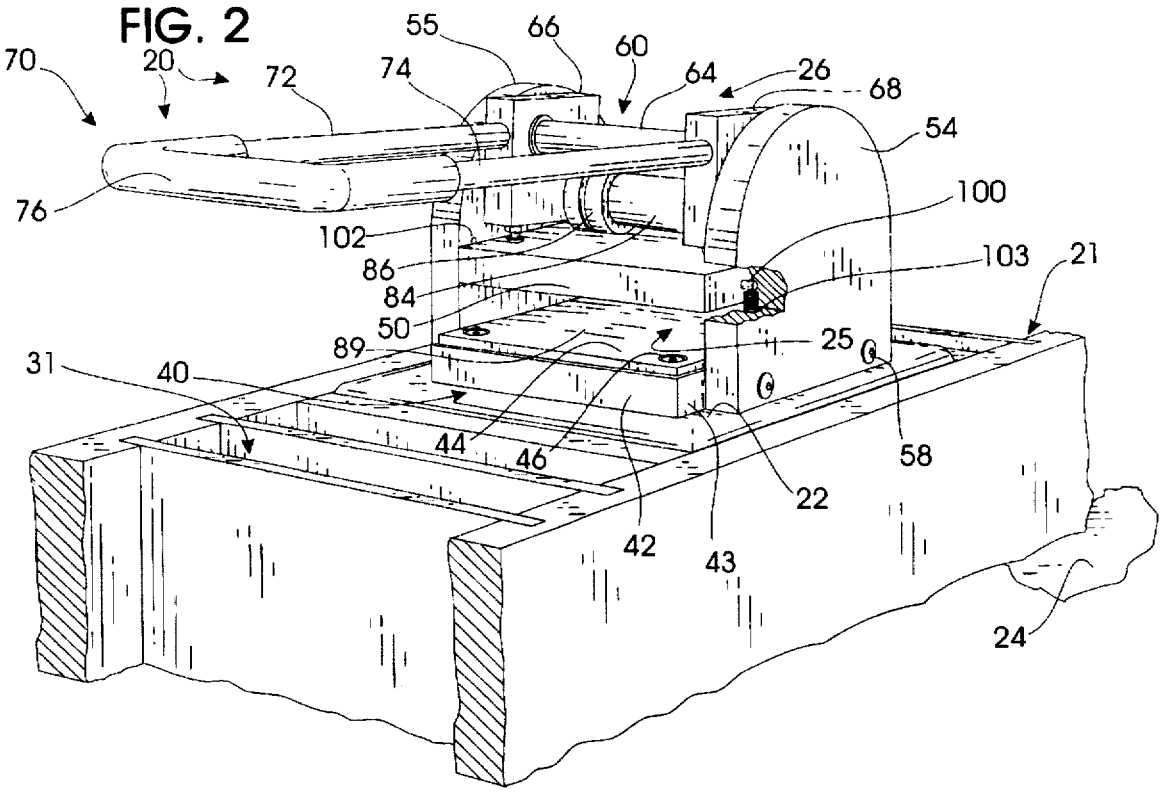
FIG. 2 is a fragmentary rear isometric view of the embodiment of FIG. 1, with portions thereof broken away for clarity.
Figure 3:
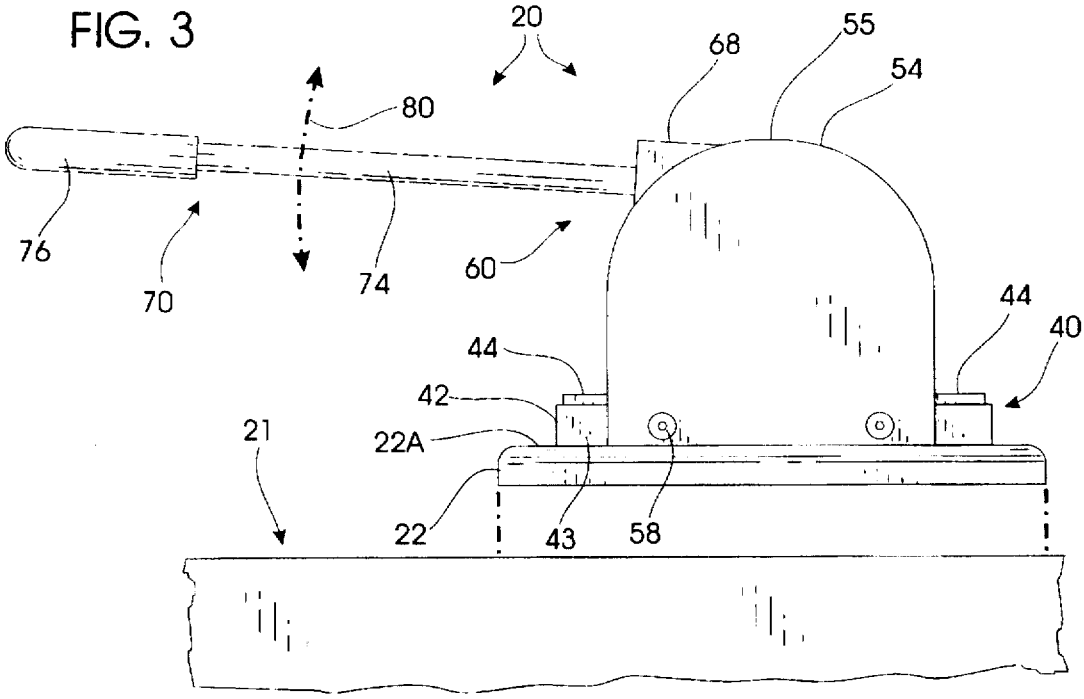
FIG. 3 is a fragmentary side elevational view of the embodiment of FIGS. 1 and 2, taken generally from a position to the right of FIG. 2, with portions shown in section for clarity.
Figure 4:
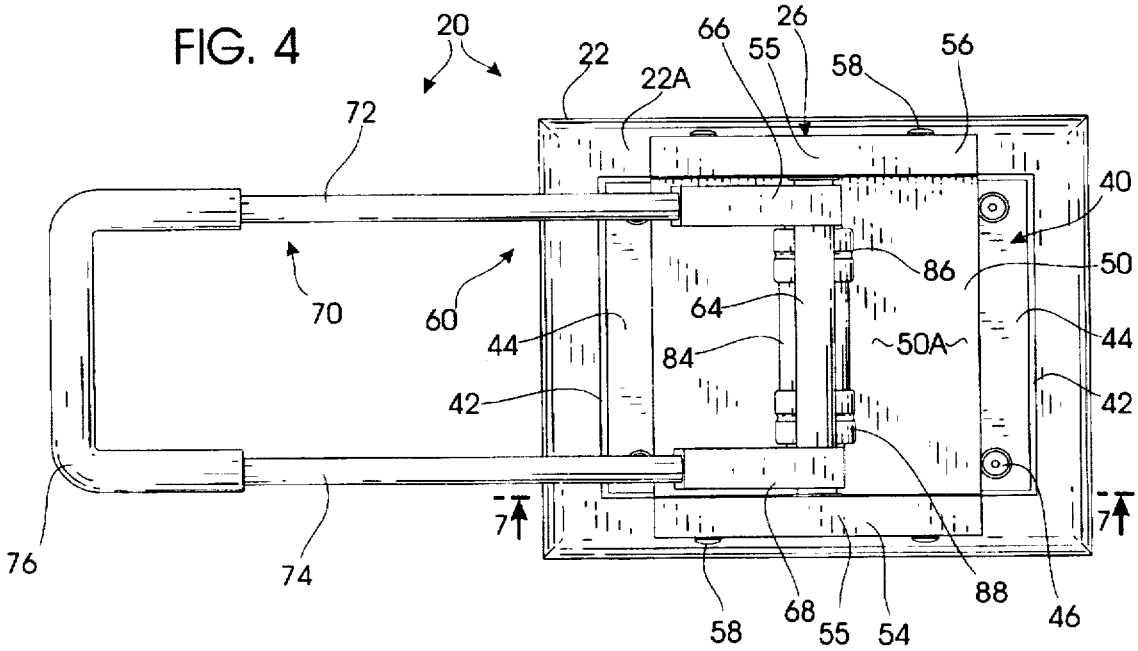
FIG. 4 is a top plan view of the embodiment of FIGS. 1, 2 and 3, with portions thereof omitted for brevity.

Platen 42 mounts a pair of upwardly extending generally parallel side plates 54 and 56 disposed at each platen edge 43 (FIGS. 1–3). Each of the side plates 54, 56 preferably comprises a rounded top 55 presenting a somewhat upright "tombstone" appearance. Each is secured to opposite edges of the stationary platen 42 by suitable fasteners 58. The alternative side plates 54A, 56A of embodiment 20A (FIG. 1A) are rectangular.

The die cutting head 26 further comprises a crankshaft means generally designated by the reference numeral 60. Crankshaft means 60 comprises an elongated pivot axle 64 (FIGS. 1, 2, 4) that extends between and is journalled within the side plates 54, 56. Pivot axle 54 is splined to pair of spaced apart pivot blocks 66 and 68 that respectively adjoin the inner surfaces of side plates 54 and 56. The opposite end of the pivot blocks 66, 68 receive portions of a handle generally designated by the reference numeral 70. Handle 70 comprises a pair of spaced apart rails 72 land 74 that are integral with a resiliently covered handle portion 76 adapted to be manually grasped. Rail section 72 is press-fitted into block 66. Portion 74 is fitted into block 68.

An elongated crankshaft 84 pivotally extends between and is journalled between blocks 66, 68. Crankshaft 84 is parallel with and spaced apart from pivot axle 64. It supports a pair of spaced-apart rollers 86, 88 on its opposite ends. As the handle 76 is moved upwardly or downwardly (i.e. as viewed in FIG. 3) in the direction of arrow 80, pivot blocks 66, 68 are forced to rotate, moving the crankshaft in an arc about the pivot axle 64, towards or away from the movable platen 50. The crankshaft rollers 86, 88 directly contact and rotate relative to surface 50A (FIG. 4) of the movable platen. Thus as the crankshaft means is operated by grasping of handle 76, the crankshaft 84, including rollers 86, 88 can be drawn either upwardly or downwardly. When the handle is pressed downwardly, the rollers 86 and 88 directly contact and slide upon the upper surface 50*a* of the movable platen to depress it downwardly toward the stationary platen system previously discussed.

Figure 5:
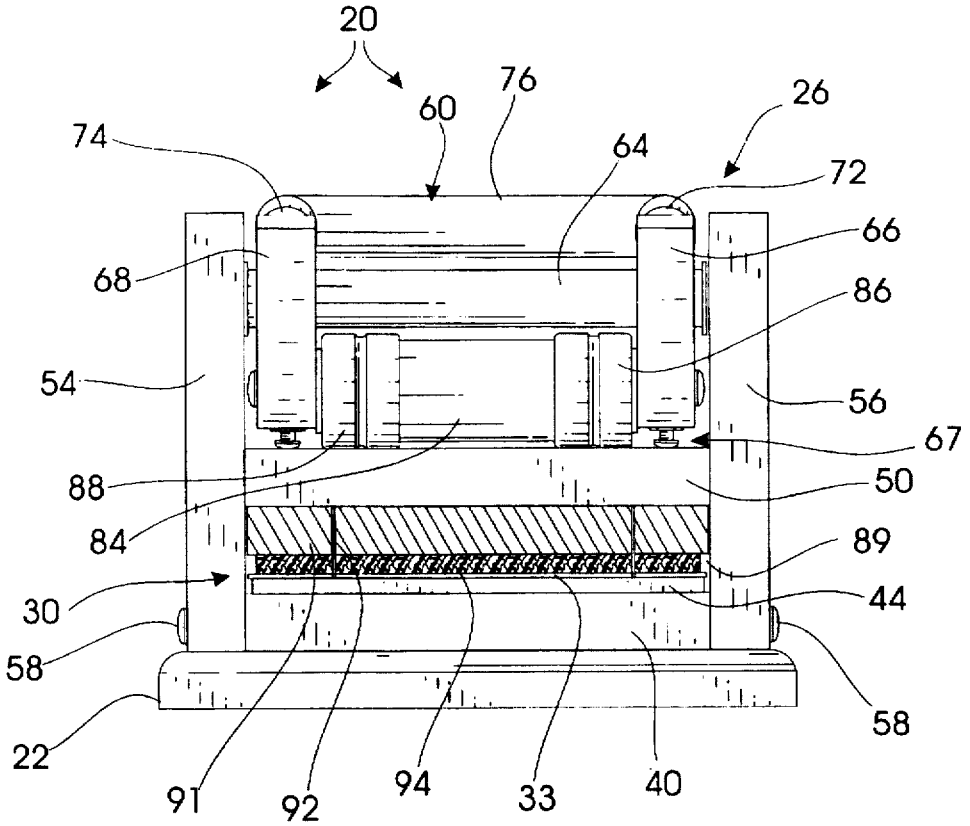
FIG. 5 is a rear plan view of the embodiment of FIGS. 1, 2, 3 and 4 with the housing omitted for clarity, primarily illustrating the die cutting head.
Figure 6:
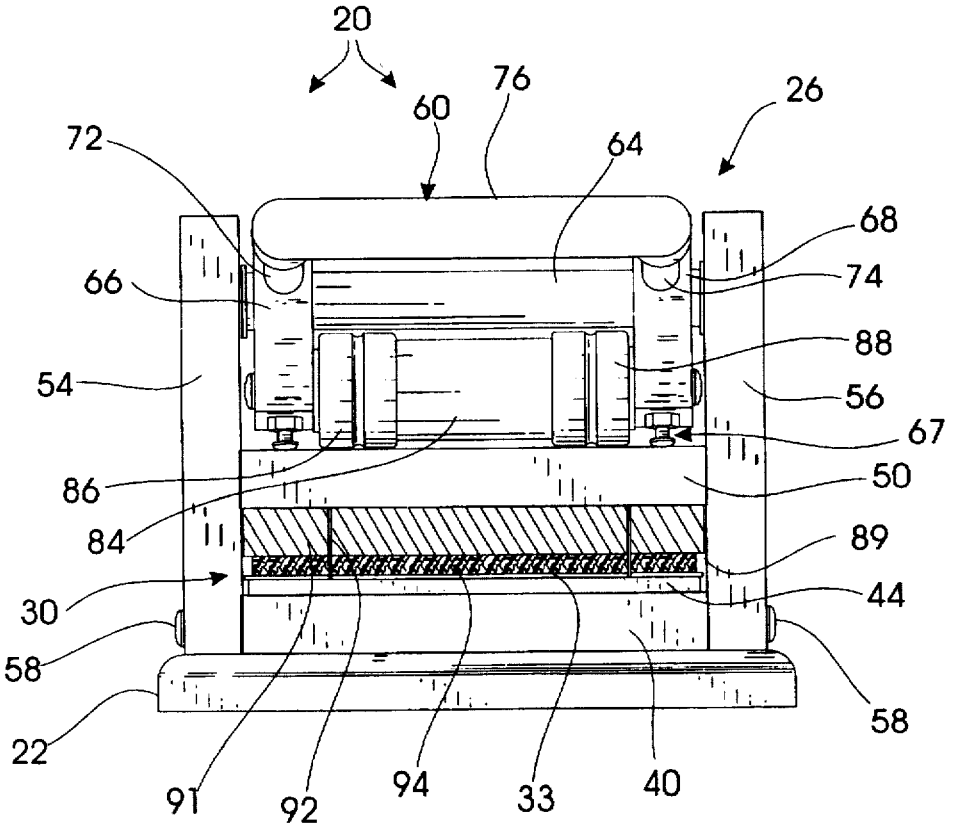
FIG. 6 is a rear plan view similar to FIG. 5, but showing the displaceable platen moved maximally downwardly.

Downward travel of the platen can be limited and optimized by the travel limit screws 67 (FIGS. 5–6). These adjustment screws are defined in the bottom of the each pivot blocks. By contacting the upper surface of the movable platen at a given rotation point, rotation and platen deflection is limited. When, for example, the pad 44 wears from repeated indentation by contact with a die blade, the limits screws can be adjusted to allow slightly more platen travel to insure effective cutting. In this fashion shimming of the pad 44 is unnecessary.

The movable platen 50 forms the upper boundary of the die-receptive compartment 25. The rigid, preferably metallic platen is of generally rectangular dimensions, and it includes a pair of outwardly projecting pins 100 (FIG. 2) on each side. These pins are captivated within suitable, generally vertically oriented and spaced apart follower slots 102, that are defined interiorly of the side plates 54 and 56. Springs 103 are captivated in slots 102 for normally biasing the movable platen away from the stationary platen.

All die cutting embodiments of this invention are designed for conventional dies 30 (FIG. 1) that may be stored within the spaced apart receptacles 31 defined within cabinet 21. When a selected die is to be used, it is inserted within the receptive compartment 25 formed between the stationary and movable platens in the die cutting head 26. A sheet of material 33 to be cut is disposed between the die and the pad 44. A desired shape is cut from construction paper 33 or the like, against which the cutting die is pressed. Each die comprises a rectangular block 91 (FIG. 1) to which a foam layer 94 is fastened. The foam surrounds the steel cutting blade 92 that is shaped as desired. For example, blade 92 in FIG. 1 is in the shape of a rabbit.

When platen 50 is moved downwardly, it forces the cutting die 30 against paper 33 and the resilient pad 44 overlying the stationary platen plate 42. In so doing, the block 91 of the cutting die is depressed downwardly by the movable platen 50. This forces blade 92 downwardly into cutting contact with the paper 33, and the paper is cut against yieldable pressure from pad 44.

Figure 7:
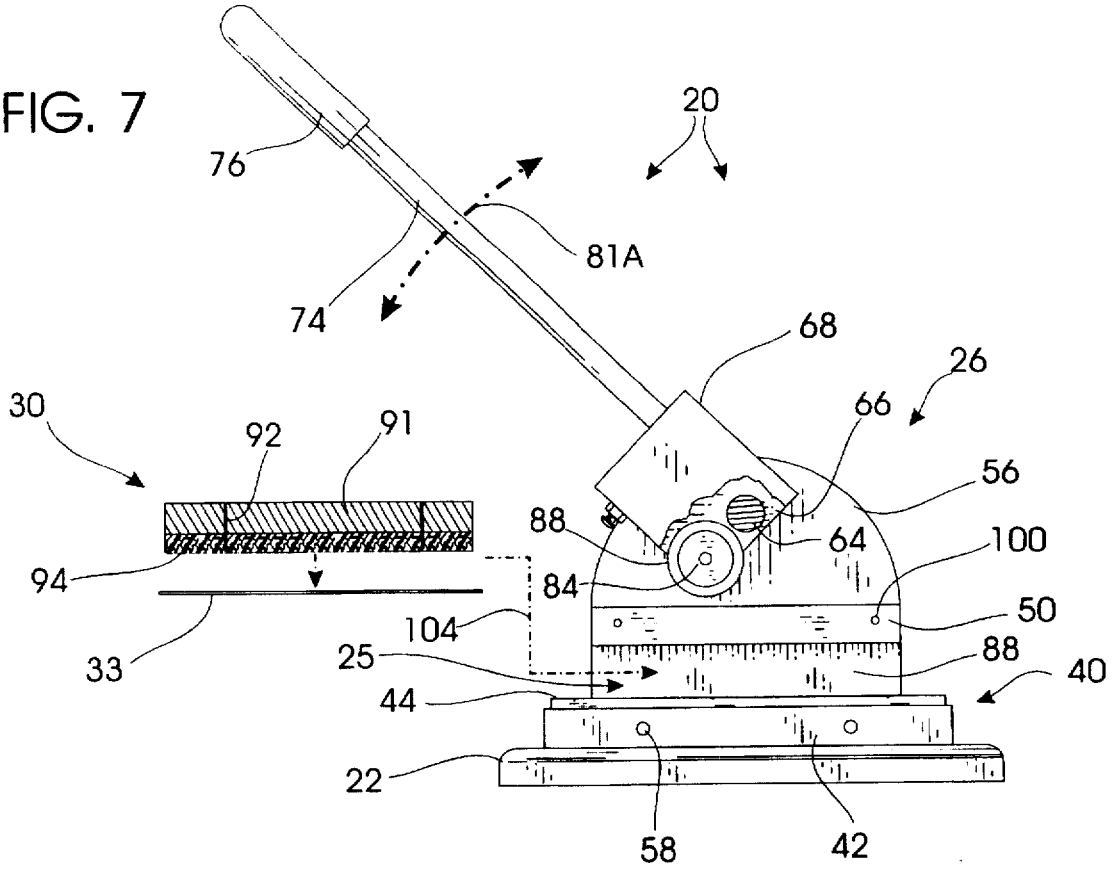
FIG. 7 is a fragmentary, sectional view of the preferred die cutting head taken generally along line along line 7—7 of FIG. 4 showing operation, with the handle in a released position.
Figure 8:
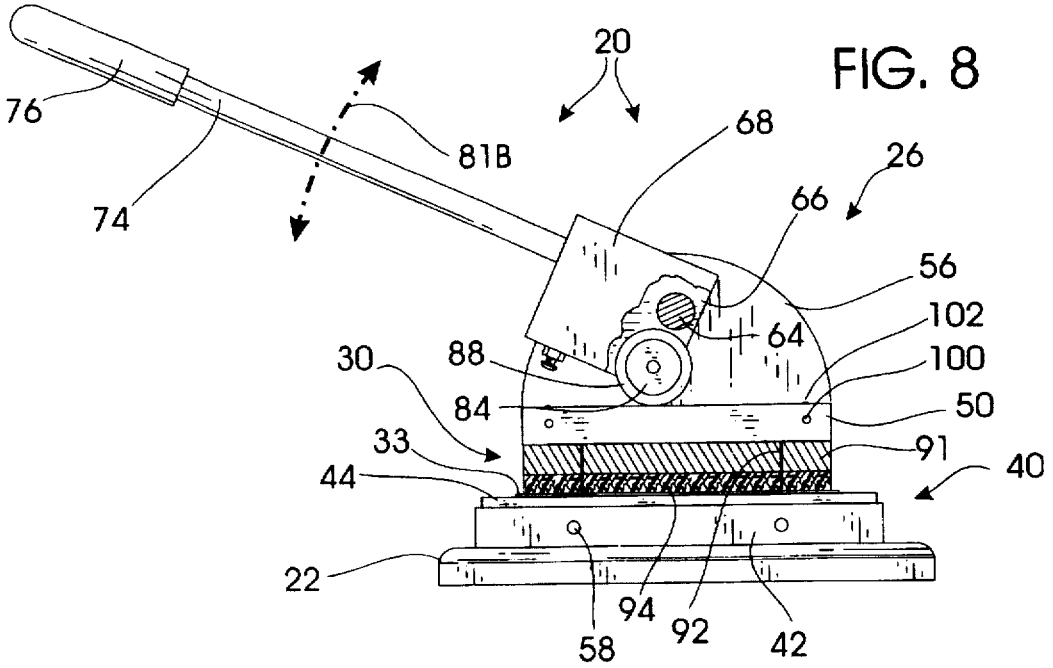
FIG. 8 is a fragmentary, sectional view similar to FIG. 7, with the handle in a neutral position.
Figure 9:
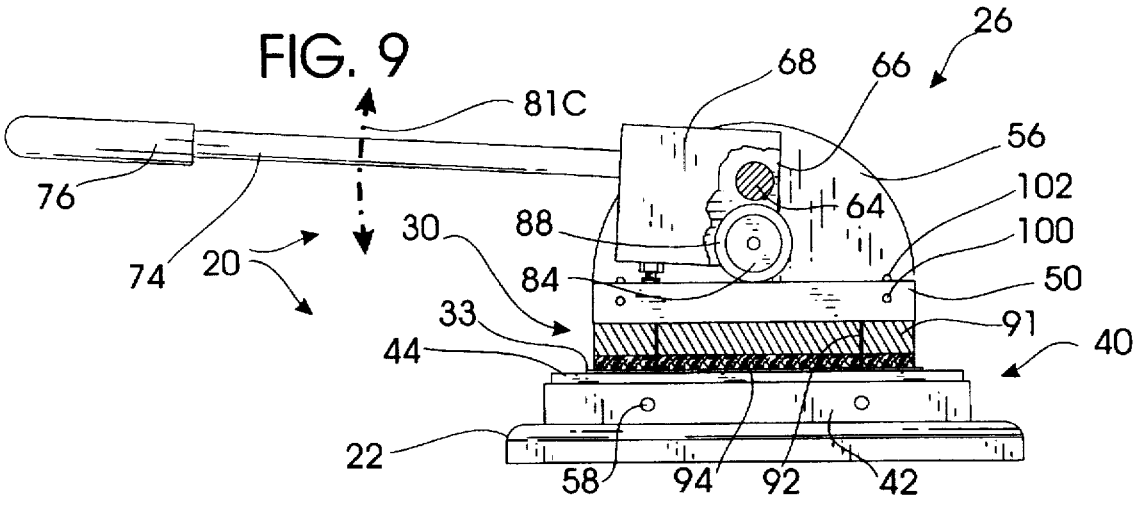
FIG. 9 is a fragmentary, sectional view similar to FIG. 7, with the handle in a tensioned position.

Operation of the manual device 20 is clarified by reference to FIGS. 7–9. A desired cutting die 30 is first withdrawn from storage in the cabinet and it is positioned over a piece of cardboard or construction paper 33 to be cut. Both are sandwiched together and moved into the receptive compartment 25 within cutting head 26 as indicated by the dashed line and arrowhead 104. Afterwards the handle 76 is grasped and moved downwardly, as represented by arrows 81A–81C in FIGS. 7–9. At this time the rollers on the crankshaft previously discussed will contact the movable platen 50, forcing it downwardly into compressive contact with the cutting die 30 beneath it. At this time the die receptive compartment shrinks. As the die cutting blade 92 is forced against the pad 44 on the lower platen, the blade will penetrate the paper 33 and produce the cutout figures desired by the operator.

Figure 10:
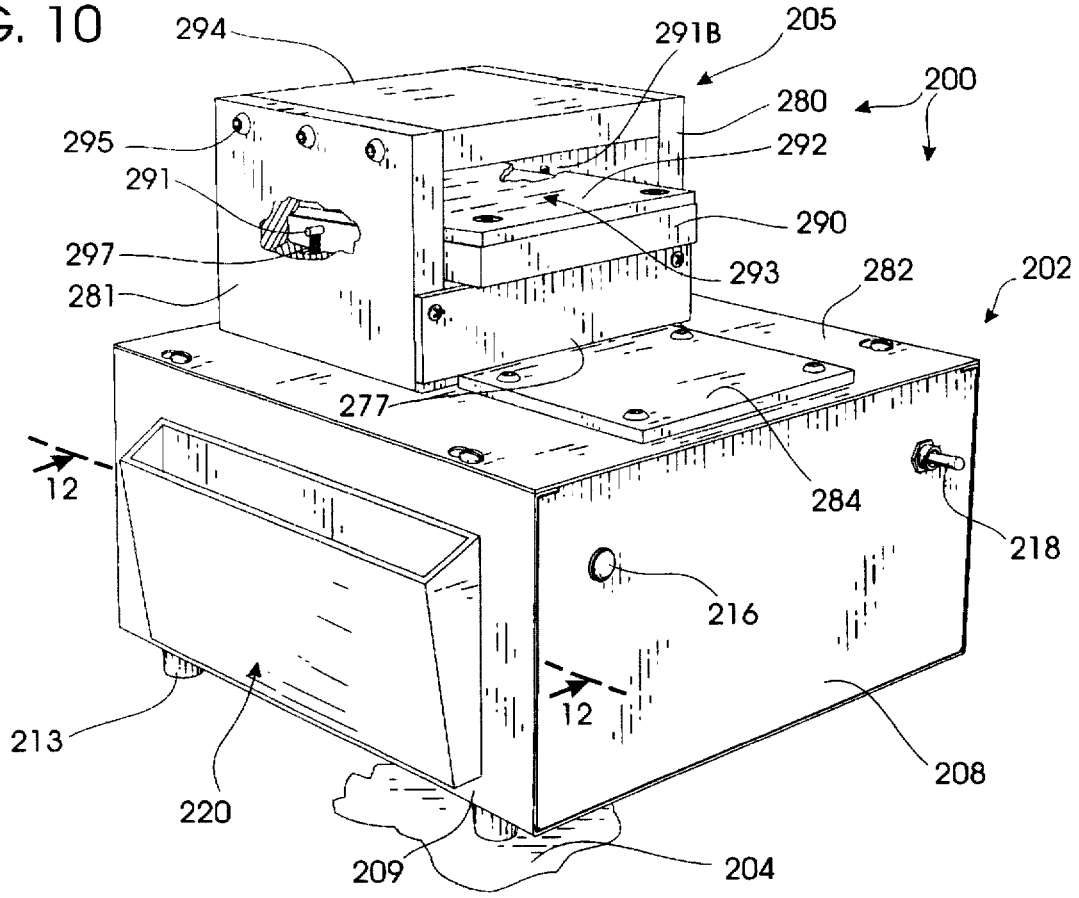
FIG. 10 is a fragmentary, front isometric view of an alternative electrically powered embodiment.
Figure 11:
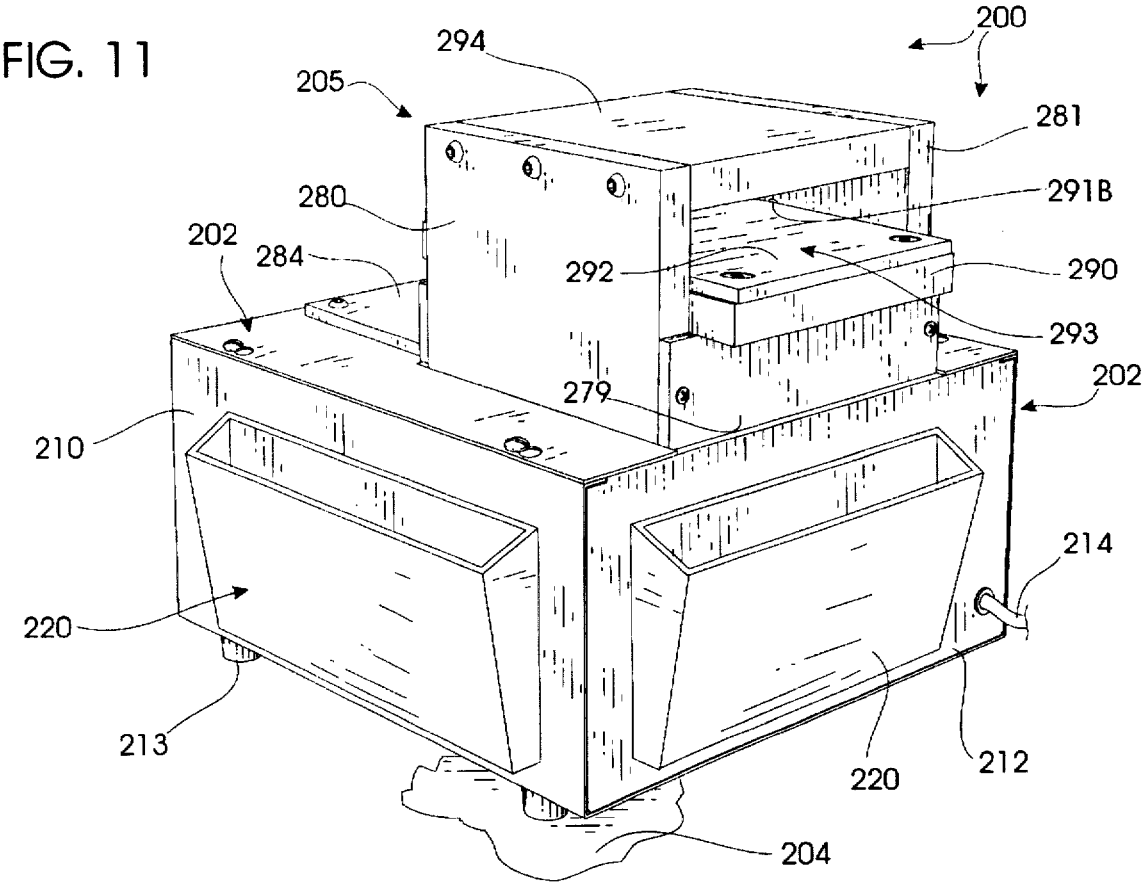
FIG. 11 is a rear isometric view of the alternative embodiment of FIG. 10 with portions broken away or shown in section for clarity.

Turning now to FIGS. 10 through 15, an alternative embodiment of my device has been generally been designated by the reference numeral 200. The electric cutting die 200 comprises a generally cubical, lower housing 202 adapted to be disposed upon a supporting surface 204 (FIG. 10). Housing 202 includes a front panel 208 and a pair of spaced apart sides 209 and 210 (FIGS. 10, 11). An inspection plate 284 overlies the top surface 282 of the lower housing 202. A conventional electrical cord 214 extends from the rear panel 212. A plurality of conventional resilient feet 213 are provided to support the cabinetry over surface 204.

Front panel 208 comprises a pilot light 216 for warning when the device is on, and a conventional on/off switch 218.

Preferably the rear panel 212 and the sides 209, 210 include resilient, translucent storage receptacles 220 that are removably attached thereto. Receptacles 220 provide storage space for a plurality of cutting dies, such as die 30 previously discussed.

Figure 14:
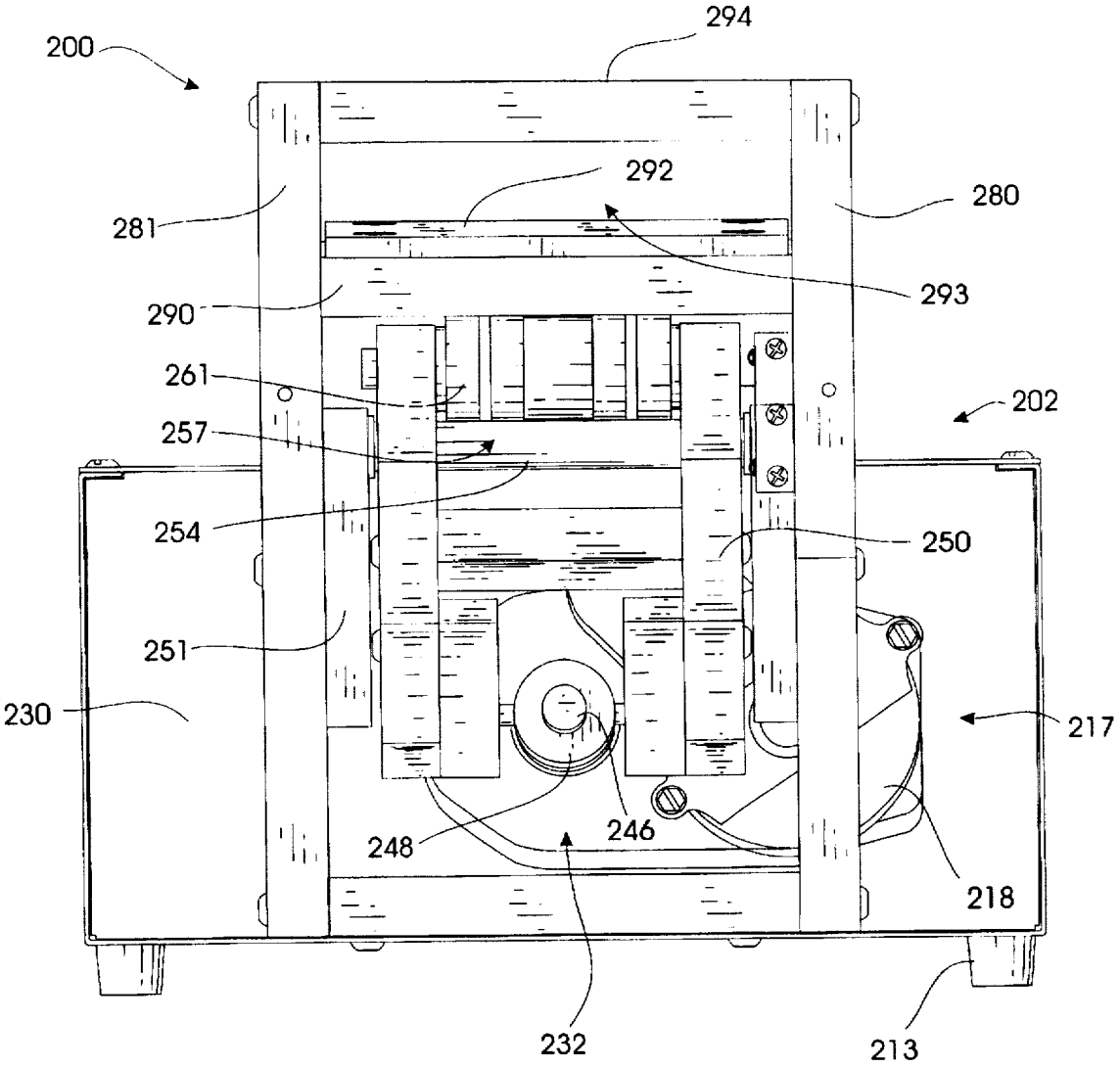

Electric die cutter 200 comprises an upper cutting head assembly 205 disposed on top of housing 202. Operative components of the assembly are disposed in the interior 230 of the housing 202. A motor carriage 217 is secured to a header 219 that is in turn pivoted through link 240 to a control block 242. A fastener 243 (FIG. 12) establishes a pivot so that the motor carriage 217 can deflect slightly upwardly or downwardly. The drive motor 244 operates a screw jack 246 threadably coupled to a socket 248 that extends between pivot lever blocks 250 (FIG. 14). Blocks 250 are captivated by an elongated pivot axle 254 that extends between offset, stationary mounting blocks 251 (FIG. 12) on the inner sides of the lower cabinet unit 202.

Pivot blocks 250 mount a transversely extending crankshaft 257 that is identical with crankshaft 84 previously discussed. As before, it includes a pair of spaced apart rollers such as rollers 261. These rollers are pressed upwardly into contact with the upper assembly 205 during operation.

Figure 12:
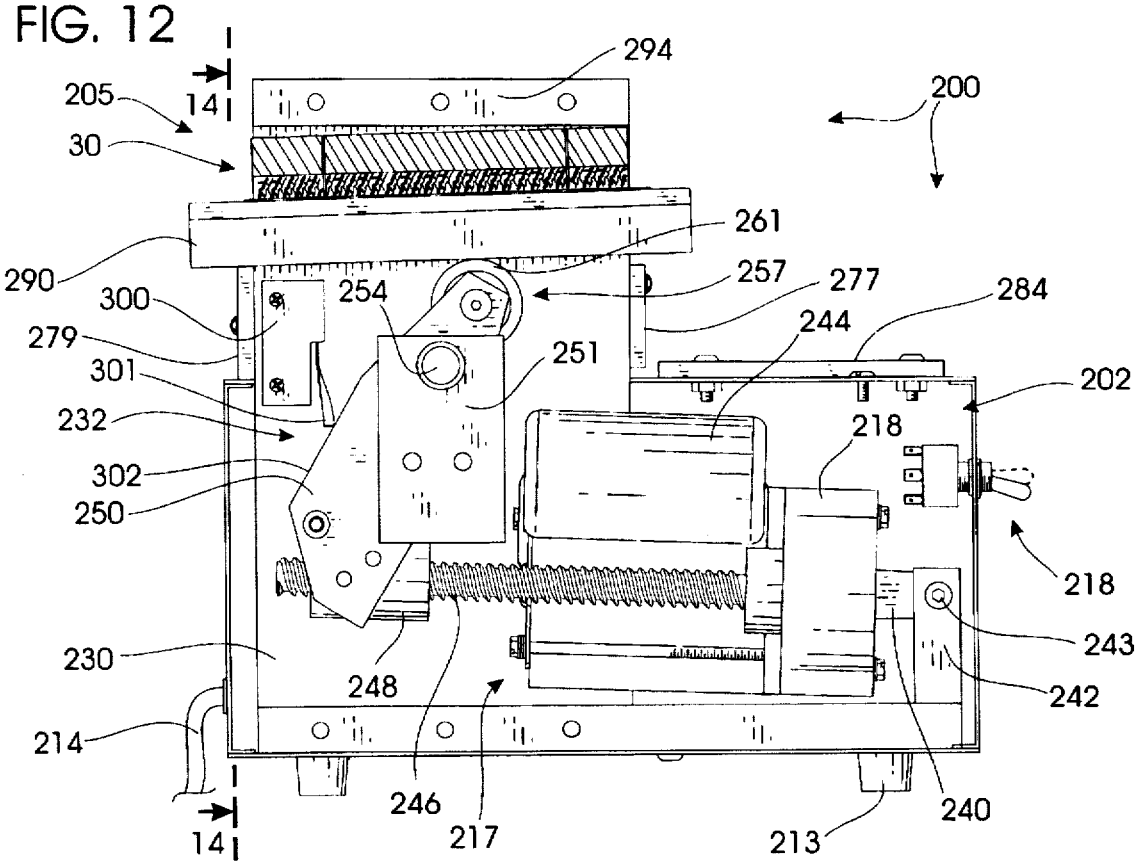
FIG. 12 is a fragmentary, longitudinal sectional view of the power driven embodiment of FIGS. 10–11 taken generally from line 12—12 in FIG. 10 and showing the interior of the machine, with portions thereof broken away or shown in section for clarity.
Figure 13:
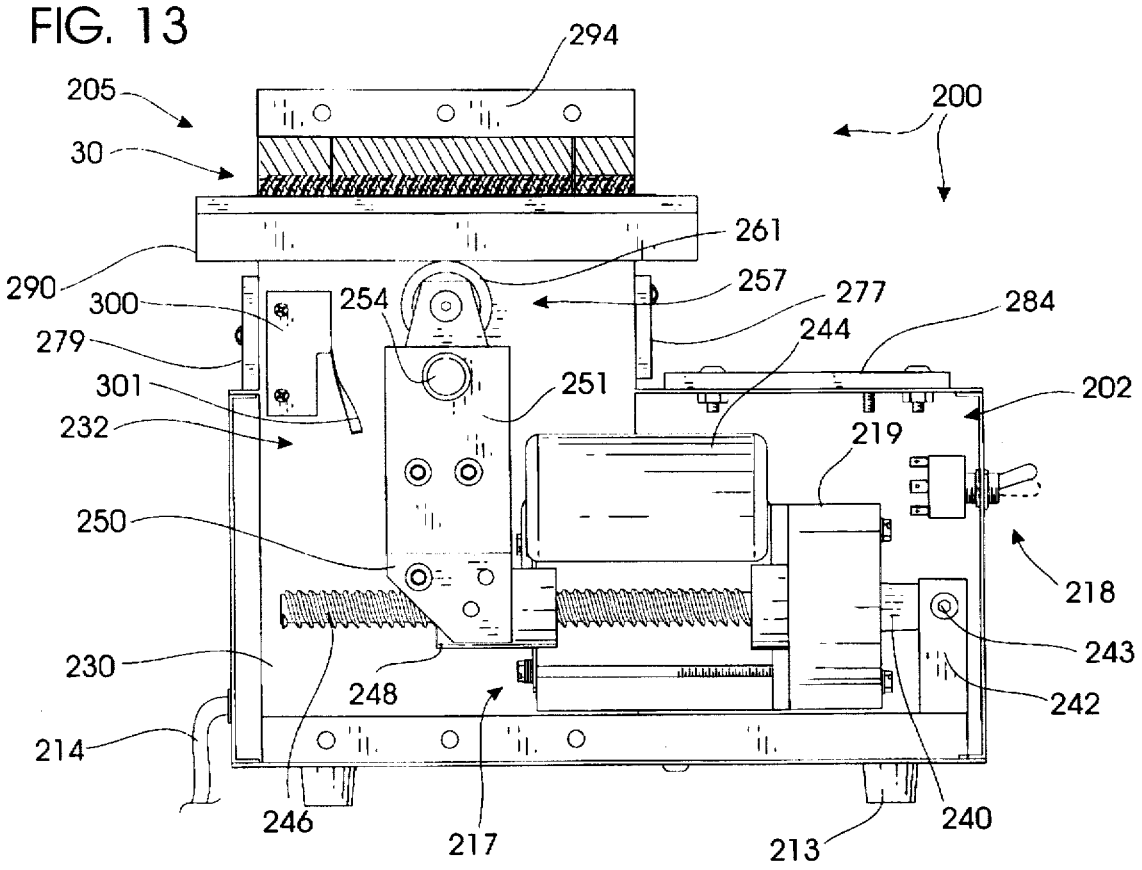
FIG. 13 is a view similar to FIG. 14, but showing the displaceable platen moved upwardly to its maximum pressure position; and, FIG. 14 is an enlarged, fragmentary sectional view taken generally along line 14—14 in FIG. 12, with portions thereof omitted for clarity and brevity.

The platen head assembly 205, as best seen in FIGS. 12 through 13, is box-like and generally cubical. A pair of side plates 280 and 281 are secured to the top surface 282 of the lower cabinet 283. The rigid side plates 280 and 281 (FIG. 10) are functionally similar to side plates 54 and 56 previously discussed. They are parallel with one another and are disposed adjacent edges of the platens as before. The transverse support plates 277, 279 (FIGS. 10–12) are disposed beneath the movable platen 290 to help support it, and to neutralize the rocking action transmitted to the platen in response to crankshaft contact.

The movable, generally rectangular platen 290 includes an upper resilient pad 292 (similar to pad 44) that is urged towards the stationary platen 294 extending between sides 280, 281. Movable platen 290 preferably comprises an outer pin 291 projecting from each of its sides. Each pin 291 is received within a suitable follower slot 291B (FIGS. 10, 11) defined in the inner surfaces of sides 280 and 281. Since in this embodiment gravity aids in returning the platen to its starting point, only two support pins have been found necessary.

Stationary platen 294 is secured by a plurality of conventional fasteners 295. The die cutters 30 are disposed within the cutting compartment 293 (FIG. 11) provided between the stationary and movable platens. The cutting action again is responsive to crankshaft activation. In this manner the paper is cut electrically, in response to proportional rotation of the screw jack 246 driven by motor 244.

When switch 218 is in the downward position illustrated, the movable platen 290 is biased away from the stationery platen 294 by slot-captivated springs 297 (FIG. 10). When the switch 218 is moved upwardly as in FIG. 15, immediate actuation of motor 244 volitionally rotates screw 246, leveraging pivot blocks 250 inwardly. At this time the roller 261 is rotated counter-clockwise (as viewed in FIGS. 14, 15) about the pivot established by axle 254. It directly abuts the underside of the laterally-captivated but vertically-movable platen 290 to cut paper as aforedescribed.

An internal limit switch 300 has a follower that tracks against the edge 302 of lever 250. When maximum deflection has been achieved, and cutting has thus occurred, the switch reverses the motor and the apparatus returns to the quiescent state.

From the foregoing, it will be seen that this invention is one well adapted to obtain all the ends and objects herein set forth, together with other advantages that are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A die cutting machine comprising:

a horizontally disposed, stationary platen having a pair of spaced apart edges;

a pair of rigid, spaced apart, side plates fastened to said stationary platen edges and extending vertically upwardly therefrom;

a horizontally oriented, moveable platen suspended between said side plates that is adapted to be moved towards said stationary platen;

a compartment formed between said stationary and movable platens and said side plates;

a removable cutting die temporarily disposed within said compartment for cutting planar material;

resilient pad means disposed in said compartment for receiving said cutting die when said moveable platen is vertically displaced towards said stationary platen;

exposed crankshaft assembly means for displacing said movable platen toward said stationary platen without marring the surface of the movable platen, and lever means extending outwardly from said crankshaft assembly means, wherein said crankshaft assembly means comprises:

an elongated, pivot axle with spaced apart ends, said pivot axle extending between said side plates and enabling relative rotation of said crankshaft assembly means;

a pivot block at each of said pivot axle ends that is adapted to be pivoted by said lever means;

roller means for slidably contacting and displacing said movable platen; and, a crankshaft extending between said pivot blocks parallel to and offset from said pivot axle, said crankshaft comprising spaced apart ends supporting said roller means adapted to travel in an arc for slidably contacting and displacing said movable platen; and, said lever means adapted to be depressed by a user for activating said die cutting machine, depression of said lever means initially pivoting said crankshaft assembly means arcuately to force said moveable platen to compress said cutting die against said resilient pad means to begin cutting the planar material and wherein subsequent lever means depression forces said crankshaft assembly means to vertically displace said moveable platen to compress said cutting die against said pad to completely cut the planar material.

2. The die cutting machine as defined in claim 1 wherein each of said pivot blocks further comprises travel limit screw means for limiting the arcuate movement of said roller means.

3. The die cutting machine as defined in claim 1 wherein said movable platen is generally rectangular and comprises spaced apart, generally parallel ends proximate each of said side plates, wherein each end comprises at least one pin and the corresponding side plate comprises at least one follower slot into which said pin is captivated for enabling aligned platen movement.

4. The die cutting machine as defined in claim 3 wherein each of said follower slots comprises a captivated spring for normally biasing said movable platen away from said stationary platen.

5. The die cutting machine as defined in claim 1 wherein said die cutting machine further comprises receptacle means for storing dies.

6. A die cutting machine comprising:

a horizontally disposed stationary platen having a pair of spaced apart edges;

a pair of rigid, spaced apart, side plates fastened to said stationary platen edges and extending vertically upwardly therefrom;

a horizontally oriented, vertically displaceable moveable platen with spaced apart ends, said moveable platen suspended between said side plates and adapted to move vertically with respect to said stationary platen;

a compartment formed between said stationary and movable platens and said side plates;

a removable cutting die temporarily disposed within said compartment for cutting planar material;

crankshaft assembly means for displacing said movable platen toward said stationary platen without marring the surface of the movable platen, and lever means for rotating the crankshaft assembly means, said crankshaft assembly means comprising:

an elongated, external pivot axle with spaced apart ends, said axle extending between said side plates and enabling relative rotation of said crankshaft assembly means;

a pivot block at each axle end adapted to be pivoted by said lever means; and, an exposed crankshaft extending between said pivot blocks parallel to and offset from said pivot axle to rotate in an arc around the pivot axle, said crankshaft comprising roller means adapted to travel in said arc for slidably contacting said movable platen while moving horizontally relative thereto and concurrently vertically depressing said moveable platen; and, said lever means adapted to be manually depressed by a user for activating the die cutting machine, said lever means secured to said pivot blocks and extending outwardly therefrom.

7. The die cutting machine as defined in claim 6 wherein said movable platen is generally rectangular and comprises spaced apart, generally parallel ends proximate each of said side plates, wherein each end comprises at least one pin and the corresponding side plate comprises at least one follower slot into which said pin is captivated for enabling aligned platen movement and wherein each of said follower slots comprises a captivated spring for normally biasing said movable platen away from said stationary platen.

8. The die cutting machine as defined in claim 7 wherein said stationary platen further comprises resilient pad means for receiving the compressive thrusts of said moveable platen.

9. The die cutting machine as defined in claim 6 wherein each of said pivot blocks further comprises travel limit screw means for limiting the arcuate movement of said roller means.

10. The die cutting machine as defined in claim 6 wherein said die cutting machine further comprises receptacle means for storing dies.

11. A die cutting machine comprising:

a horizontally disposed, stationary platen having a pair of spaced apart edges;

a pair of rigid, spaced apart, side plates fastened to said stationary platen edges and extending vertically upwardly therefrom;

a horizontally oriented, moveable platen suspended between said side plates that is adapted to be moved towards said stationary platen, said movable platen being generally rectangular and comprising spaced apart, generally parallel ends proximate each of said side plates, wherein each end comprises at least one pin and the corresponding side plate comprises at least one follower slot into which said pin is captivated for enabling aligned platen movement;

spring means captivated within each of said follower slots for normally biasing said movable platen away from said stationary platen;

a compartment formed between said stationary and movable platens and said side plates;

a removable cutting die temporarily disposed within said compartment for cutting planar material;

resilient pad means disposed in said compartment for receiving said cutting die when said moveable platen is vertically displaced towards said stationary platen;

crankshaft assembly means for displacing said movable platen toward said stationary platen without marring the surface of the movable platen, said crankshaft assembly means comprising:

axle means secured to said side plates for rotating said crankshaft assembly means; and roller means for slidably contacting and displacing said movable platen, said roller means traveling arcuately in response to pivotal movement of said axle means;

lever means extending outwardly from said crankshaft assembly means and adapted to be depressed by a user for activating said die cutting machine, depression of said lever means initially pivoting said crankshaft assembly means arcuately to initially force said moveable platen against said resilient pad means and wherein subsequent lever means depression forces said crankshaft assembly means to vertically displace said moveable platen to compress said cutting die against said pad to completely cut the planar material; and receptacle means for storing dies.

* * * * *